United States Patent [19]

Nishimura et al.

[11] 4,271,450

[45] Jun. 2, 1981

[54] CIRCUIT ARRANGEMENTS FOR THE CONTROL OF A BISTABLE RELAY

[75] Inventors: Hiromi Nishimura; Hideki Fukuzono, both of Osaka, Japan

[73] Assignees: Matsushita Electric Works, Ltd., Osaka, Japan; SDS-Electro GmbH, Deisenhofen, Fed. Rep. of Germany

[21] Appl. No.: 48,890

[22] Filed: Jun. 15, 1979

[30] Foreign Application Priority Data

| | | | |
|---|---|---|---|
| Jun. 15, 1978 | [JP] | Japan | 53-73063 |
| Jun. 15, 1978 | [JP] | Japan | 53-73067 |
| Jun. 15, 1978 | [JP] | Japan | 53-73069 |
| Sep. 25, 1978 | [JP] | Japan | 53-132113[U] |
| Oct. 19, 1978 | [JP] | Japan | 53-129378 |

[51] Int. Cl.[3] ..... H01H 47/00; H01H 47/32

[52] U.S. Cl. ..... 361/155; 361/205; 307/273

[58] Field of Search ..... 361/160, 206, 156, 205, 361/155; 307/273, 289

[56] References Cited

U.S. PATENT DOCUMENTS

| | | | |
|---|---|---|---|
| 3,544,849 | 12/1970 | Speaker | 361/205 X |
| 3,564,345 | 2/1971 | Baynard | 361/205 X |
| 3,946,287 | 3/1976 | Hopkins | 361/205 X |
| 4,138,708 | 2/1979 | Takeshima | 361/156 |

FOREIGN PATENT DOCUMENTS

| | | | |
|---|---|---|---|
| 2511564 | 9/1976 | Fed. Rep. of Germany | 361/205 |
| 2624913 | 10/1977 | Fed. Rep. of Germany | 361/205 |

OTHER PUBLICATIONS

Sauer, H., *Relais Lexicon,* 1st Ed., 1975, p. 12.

*Primary Examiner*—J. D. Miller
*Assistant Examiner*—L. C. Schroeder
*Attorney, Agent, or Firm*—Thomas E. Beall, Jr.

[57] ABSTRACT

Circuit arrangements for the control of a bistable relay having a capacitor connected in series with the relay coil. The series connection of the coil and the capacitor is connected to an excitation voltage for actuating the relay and simultaneous charging of the capacitor. When the excitation voltage is removed, the series connection is short-circuited through a semiconductor switch, whereby the capacitor is discharged and the relay switched back to its initial position. The bistable relay is thus operated as monostable relay.

16 Claims, 12 Drawing Figures

CIRCUIT ARRANGEMENTS FOR THE CONTROL OF A BISTABLE RELAY

BACKGROUND OF THE INVENTION

A circuit arrangement for switching-over a bistable relay with the aid of a semiconductor is, for example, known from the book "Relais Lexikon" (Relay Lexicon) by H. Sauer, first edition, 1975, page 12. Upon application of an excitation voltage, a first transistor connected in series with the relay coil and a capacitor is conductive, the relay is actuated and the capacitor is charged. When a positive control signal is provided at the input of a second transistor, the first transistor is blocked, and a third transistor connected in parallel to the coil and the capacitor is rendered conductive. The capacitor is discharged through this third transistor and the relay switches back. If the control signal jumps to zero value, then the second and third transistors are again blocked, the first transistor becomes conductive and the capacitor is again charged, so that the relay switches over.

A circuit arrangement of this type is expedient for this operation of bistable relays when the polarity of the excitation voltage remains unchanged. The relay remains in its switched position after the capacitor has been charged, independent of whether the excitation voltage is switched off or continues. A diode prevents slow discharging of the capacitor when the excitation voltage is absent. The relay may be switched back only by a positive control pulse at the input of the second transistor. Since this pulse cannot be produced from the excitation voltage when the latter is switched off, an external control signal source is necessary.

Furthermore, a circuit arrangement for controlling a bistable relay is known from German published patent application No. 2 624 913, in which this circuit arrangement acts as a monostable relay and thus switches back automatically to the starting position upon insufficiency of the excitation voltage. This is attained by connecting an evaluation circuit fed with the excitation voltage between the junction of the coil and the capacitor, on the one hand, and the control electrode of the semiconductor switch, on the other hand, the evaluation circuit blocking the semiconductor when the excitation voltage is present and rendering the semiconductor conductive when such voltage is absent. For preventing inadvertent discharge of the capacitor, a diode is also connected in the current path. A series resistance in the same path serves for short-circuit-proofing the semiconductor as well as for realizing—if properly sized—a defined voltage drop, so that the relay may be provided with economic low-voltage winding and may be operated at higher voltages, such as line voltage. However, the evaluation circuit required to achieve the monostable function of the relay leads to a relatively high expenditure of components.

SUMMARY OF THE INVENTION

It is an object of this invention to devise a circuit arrangement of the afore-mentioned type, such that upon removal of the excitation voltage, the desired automatic switching back of the bistable relay is attained, as in the known arrangement but with reduced expenditure of components.

It is another object of this invention to provide a circuit of the above type, which avoids malfunction of the bistable relay even in case the excitation voltage drops abruptly.

Another object of the invention is to provide a circuit of the above type which is capable of actuating the bistable relay without requiring a capacitor of large capacity, even in case the excitation voltage drops abruptly.

As a further object of the present invention, a circuit of the above type is to be provided which ensures accurate switching-over action of the bistable relay at a predetermined voltage level even in case the excitation voltage increases at a slow rate.

It is still another object of the invention to provide a circuit arrangement of the afore-mentioned type in which the consumption of electric power is minimized.

The above and further objects of the invention are met by a circuit arrangement as defined in the appended claims.

DETAILED DESCRIPTION OF PREFERRED EMBODIMENTS

Figure 1:
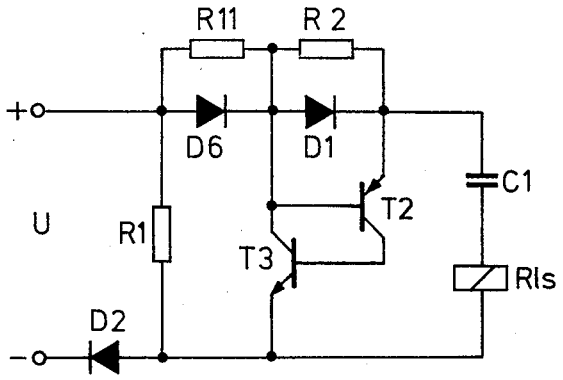
FIG. 1 shows a circuit for controlling a bistable relay according to a first embodiment of this invention.

In the circuit shown in FIG. 1, an ohmic resistor R1 is connected in parallel to the terminals of an excitation voltage U. Also connected between the two voltage terminals is a series connection of two diodes D6, D1, a capacitor C1, and the coil of a relay Rls. The diode D1 is by-passed by an ohmic resistor R2, and the diode D6 is by-passed by an ohmic resistor R11. A trigger stage consisting of two transistors T2, T3 of opposite conductivity type is also connected in parallel to the diode D1. The collector electrode of each transistor is coupled with the base electrode of the respective other transistor, the diode D1 lying between the collector of the transistor T3 and the emitter of the transistor T2, and the emitter of the transistor T3 being connected to the other voltage terminal. A diode D2 serves to protect the transistors against false polarity of the excitation voltage U.

When the excitation voltage U is applied, the relay Rls is energized by the current charging the capacitor C1. The relay thus switches over. Voltage drops appear across the diodes D6, D1 in the amount of the threshold voltages of these diodes. The pnp-transistor T2 is thereby blocked and, as a result, the npn-transistor T3 is also blocked.

After the capacitor C1 has been charged completely, the current which flows is that required for providing additional charge to the capacitor as well as a small current through the resistor R1.

When the excitation voltage U is removed, the transistor T2 will become forwardly biassed by the voltage drop now appearing across the diode D1 and the resistor R2, the base current of the transistor T2 will now flow through the parallel connection of the diode D6 and the resistor R11 and through the resistor R1, so that the complementary transistor T3 will also be biassed in the forward direction. The trigger stage consisting of the transistors T2, T3 is thus actuated. The capacitor C1 is thereby discharged through the relay coil so that the relay Rls is switched back to its initial condition.

Figure 2:
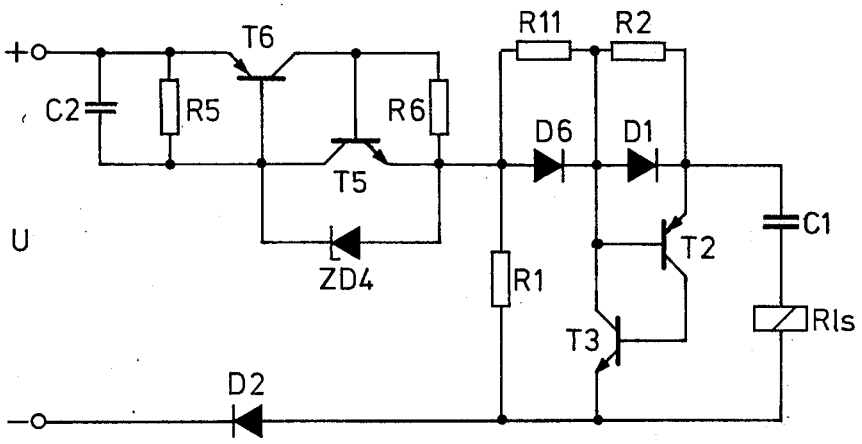
FIG. 2 shows the same circuit as FIG. 1, supplemented by a trigger stage.

As a development of the embodiment shown in FIG. 1, FIG. 2 provides a further trigger stage comprising complementary transistors T5, T6 and connected between the positive energization voltage terminal and the anode of the diode D6. A reference voltage is provided at the base electrode of the first trigger stage transistor T6 by a Zener diode ZD4 connected between the emitter and collector electrodes of the second transistor T5.

Figure 3:
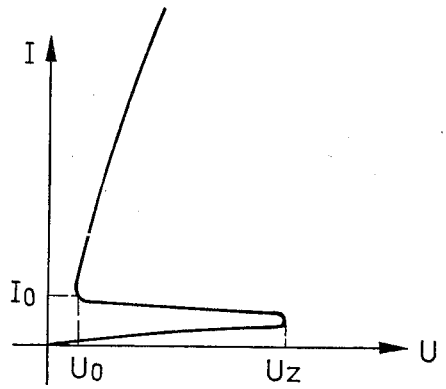
FIGS. 3 and 4 are graphs explaining the operation of the circuit shown in FIG. 2.
Figure 4:
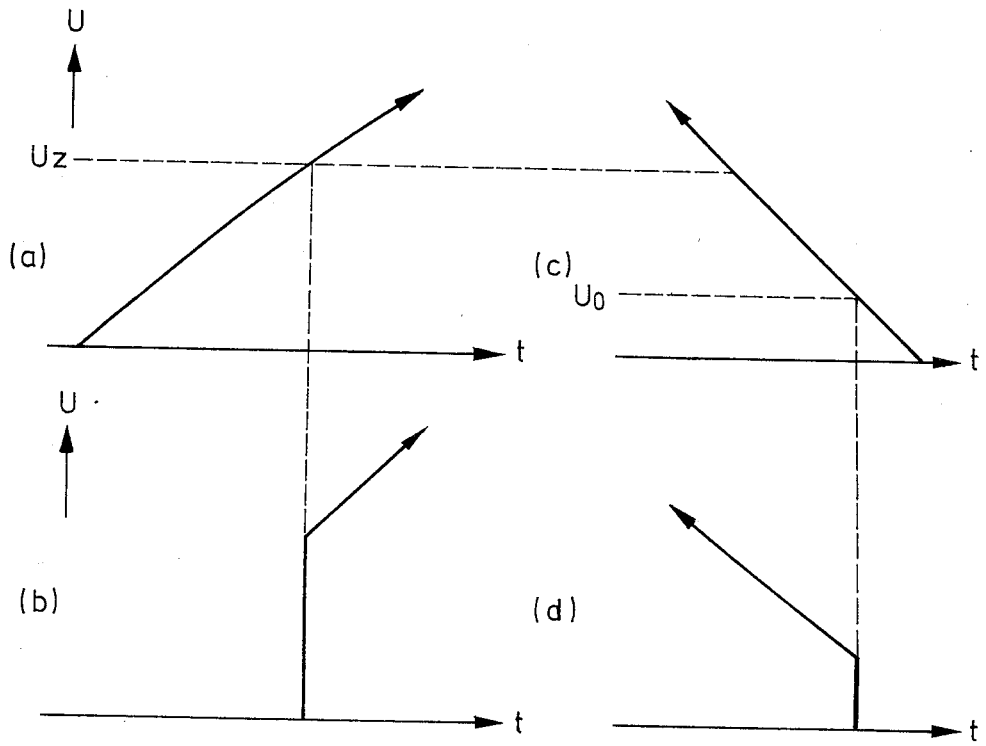

The operation of the circuit shown in FIG. 2 will now be explained with reference to FIGS. 3 and 4, with FIG. 3 representing the characteristic of the Zener diode D4, and FIG. 4 the switching characteristic of the circuit at rising and dropping excitation voltage U. When the excitation voltage U rises slowly, as shown in FIG. 4(*a*), current begins to flow only when the Zener voltage Uz is reached. It is only from this moment on that the voltage becomes active in the series connection comprising the relay Rls and the capacitor C1, as shown in FIG. 4(*b*). The capacitor is now charged and the relay is energized. When the excitation voltage drops in accordance with FIG. 4(*c*), the Zener diode ZD4 remains conductive until the residual voltage Ua is reached. When the voltage falls below this residual voltage, the trigger stage containing the Zener diode ZD4 and the transistors T5, T6 is blocked, which results in the voltage characteristic shown in FIG. 4(*d*) at the output of the trigger stage. In this moment, the capacitor C1 begins to discharge through the trigger stage T2, T3 and the relay is switched back to its initial condition.

In order to ensure that the residual currents of the transistors T5, T6 are maintained small and to avoid inadvertent switching-over of the trigger stage formed by these transistors, an ohmic resistor R5 is connected between the emitter and the base of the transistor T6. A capacitor C2 also connected between the base and the emitter of this transistor prevents the trigger stage from switching-over too early upon application of the excitation voltage U.

Figure 5:
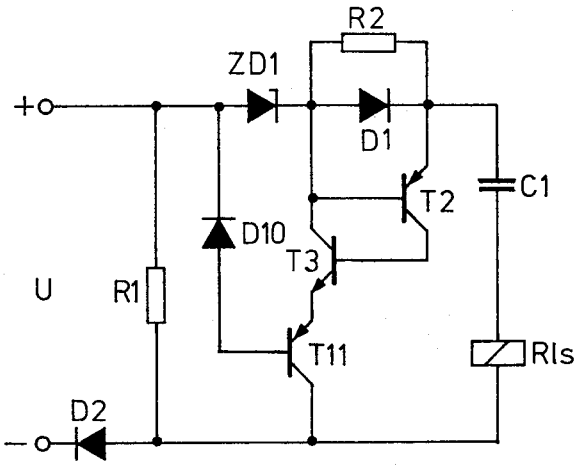
FIG. 5 shows another modification of the circuit of FIG. 1.

FIG. 5 shows an alternative of the circuit of FIG. 1, according to which the parallel connection of the diode D6 and the resistor R11 of FIG. 1 is replaced by a Zener diode D1, and an additional pnp-transistor T11 is inserted into the emitter circuit of the transistor T3, the base electrode of the transistor T11 being connected to the positive terminal of the excitation voltage U through a diode D10 backwardly poled with respect to the excitation voltage. The additional provision of the transistor T11 in connection with the diode D10 ensures reliably that the trigger stage comprising the transistors T2, T3 remains blocked even in case excessive excitation voltages occur.

Figure 6:
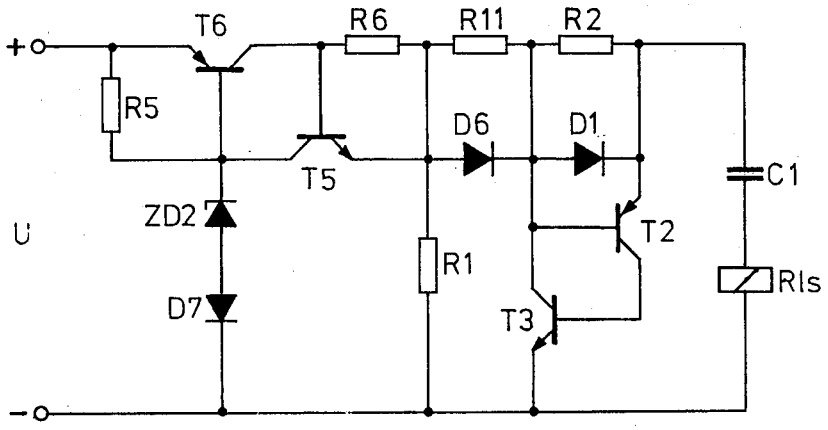
FIG. 6 shows a modification of the circuit of FIG. 2.
Figure 7:
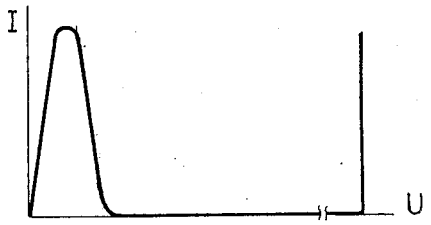
FIG. 7 is a graph showing the characteristic of a component used in the circuit of FIG. 6.

FIG. 6 shows an alternative of the circuit arrangement of FIG. 2, which is particularly economic for a circuit design using discrete circuit elements. The reference voltage applied to the base of the transistor T6 is established by a series connection of the resistor R5 with a Zener diode ZD2 and a diode D7, with FIG. 7 showing the characteristic of the diode D7. When the excitation voltage U exceeds this reference voltage, the trigger stage T5, T6 becomes conductive to energize the relay Rls.

Figure 8:
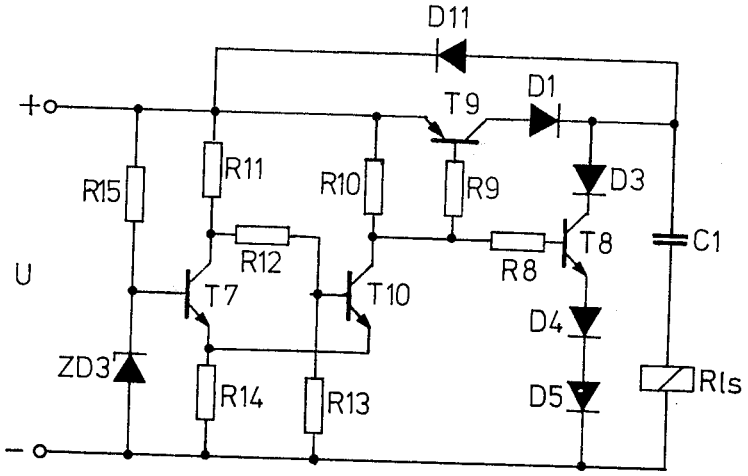
FIGS. 8 to 12 show further embodiments of the circuit according to this invention, with the circuit of FIG. 9 being a variation of that shown in FIG. 8, FIG. 10 showing a modification of the circuit according to FIG. 2, and FIG. 12 representing a modification of the circuit shown in FIG. 11.

In the embodiment of FIG. 8, the diode D1 is connected in series with a further semiconductor switch which is of the complementary conductivity type to the semiconductor switch connected in parallel to the series connection of the relay coil and the capacitor C1. Furthermore, a voltage divider is connected between the terminals of the excitation voltage U, control electrodes of the semiconductor switch being connected to a tap of the voltage divider for alternating control thereof. The potential at the tap of the voltage divider is so selected that upon application of the excitation voltage U, the further semiconductor switch becomes conductive so that the charging current of the capacitor S1 flows through the diode D1 and the relay coil, while the first semiconductor switch is blocked. Upon removal of the excitation voltage U, the further semiconductor switch is blocked and the first semiconductor switch becomes conductive to discharge the capacitor, whereby the relay is switched back to its initial condition.

In particular, a npn-transistor T8 is provided as the first semiconductor switch and a pnp-transistor T9 is provided as second semiconductor switch in FIG. 8. The collector of the npn-transistor T8 is connected with the cathode of the diode D1, while the emitter of this transistor is connected with the common ground potential of the circuit. The pnp-transistor T9 is coupled with its collector to the anode of the diode D1 and with its emitter electrode to a terminal of the excitation voltage U. The voltage divider consists of an ohmic resistor R10 and a further resistance connected between the tap and the common ground potential. Both transistors T8, T9 have their base terminals connected to the tap of the voltage divider, and ohmic resistors R8, R9 are coupled between the tap of the voltage divider and the base electrode of the respective transistors T8, T9.

The further resistance of the voltage divider not illustrated in FIG. 8 is formed by the output circuit of a Schmitt trigger T7, T10 fed with the excitation voltage U. A reference voltage derived from the excitation voltage U is provided at the input of this Schmitt-trigger such that the switch-over points of the Schmitt-trigger determine the energization and deenergization voltages of the relay.

To ensure that the emitter potential of the transistor T8 clearly lies above its collector potential with the transistor T10 conductive, and that the transistor T8 blocks, two diodes D4, D5 are connected in the conductive direction between the emitter electrode of the transistor T8 and ground potential. A diode D3 in the collector path of transistor T8 prevents inadvertent gradual charging of capacitor C1 through the resistors R10, R8.

With slowly increasing excitation voltage U, the transistor T7 is first biassed in its forward direction. Thus, the transistor T10 blocks. The common voltage divider tap has more positive potential than the emitter electrode of the transistor T8, such that this transistor is conductive and T9 is blocked. It is thus ensured that the capacitor C1 is discharged.

If, as a result of the increasing excitation voltage U, the sum of the base-emitter voltage of the transistor T7 and the voltage drop across the resistor R14 exceeds the Zener voltage $U_{ZD3}$ at the base electrode of T7, the transistor T7 will be blocked and the transistor T10 will become conductive. At this first switch-over point of the Schmitt-trigger, the common voltage divider tap receives a more negative potential than the emitter electrodes of the transistors T8, T9, so that the transistor T9 will become conductive and the transistor T8 will be blocked. Now, the charging current of capacitor C1 flows and the relay is excited.

With decreasing excitation voltage U, the second switch-over point of the Schmitt-trigger will be reached when the sum of the voltage drops across the base-emitter path of the transistor T7 and across the resistor R7 falls below the Zener voltage UD3. Now again transistor T7 becomes conductive and transistor T10 is blocked. In consequence, the transistor T9 is blocked and the transistor T8 is conductive, whereby the capacitor C1 is discharged and the relay switches back.

In order to ensure the proper operation of the Schmitt-trigger in case the excitation voltage U is off, the current required by the Schmitt-trigger is supplied from the capacitor C1 via a diode D11 bridging the transistor T9 and the diode D1.

The circuit of FIG. 8 is advantageous especially in case it is to be manufactured in integrated form because no large capacities except the capacitor C1 are required.

Figure 9:
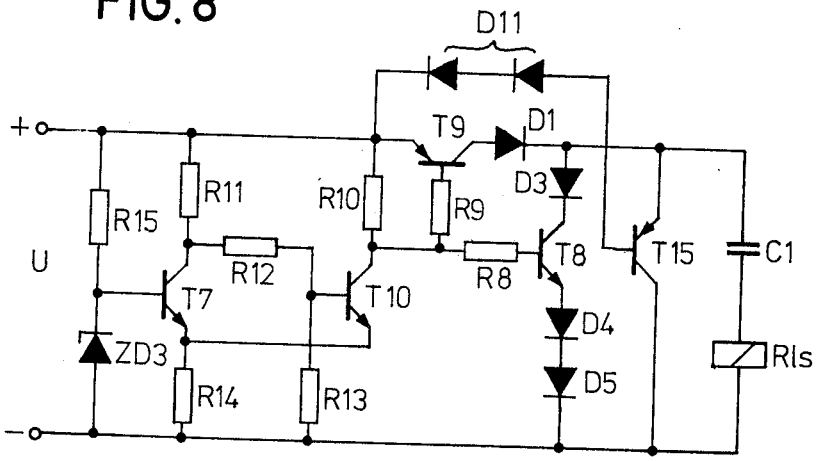

Another possibility to provide the energy required by the Schmitt-trigger T7, T10, when the excitation voltage is switched off, resides in accordance with FIG. 9 in a pnp-transistor T15 connected in parallel to the series connection of the capacitor C1 and the relay coil Rls, the base electrode of the transistor T15 being connected to the positive side of the excitation voltage U through reversely poled diodes D11. As long as the excitation voltage is present, the diodes D11 and thus the transistor T15 are blocked. With the excitation voltage switched off, however, the transistor T15 becomes conductive thereby supplying its base current via the diodes D11 to the Schmitt-trigger T7, T10 which drives the transistor switch T8. This transistor switch again short-circuits the series connection formed by the capacitor C1 and the relay coil Rls.

Figure 10:
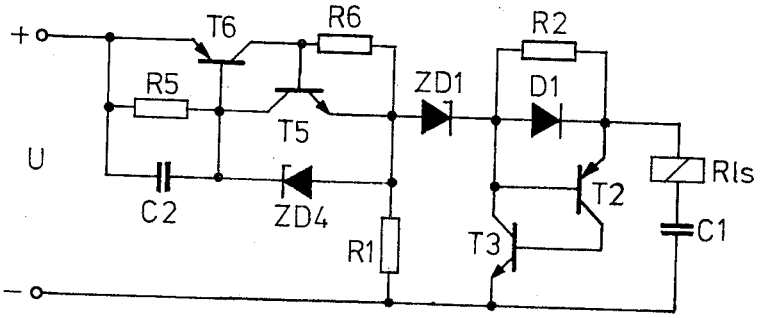

A further development of the circuit arrangement of FIG. 2 is shown in FIG. 10. Just as in FIG. 2, the Zener diode ZD4 connected between the base electrode of the first trigger transistor T6 and the emitter electrode of the second trigger transistor T5 causes the trigger stage to become conductive only when the Zener voltage is exceeded.

Each Zener diode in any of the above circuits can be replaced by a parallel circuit of two diode branches in which one branch contains a plurality of diodes all connected in series in the same direction, and the other branch includes one single diode connected anti-parallel to the diodes in the first branch. For instance, if the Zener diodes ZD1 and/or ZD4 in FIG. 10 are replaced by diode parallel connections of this type, the deenergization voltage of the relay is determined by the number of diodes connected in series in the first branch.

Figure 11:
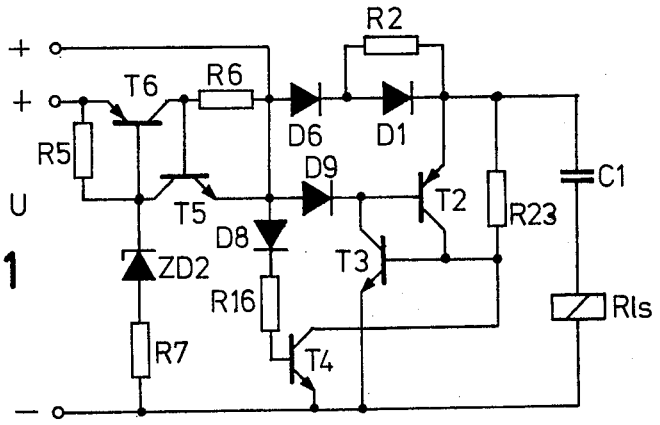
Figure 12:
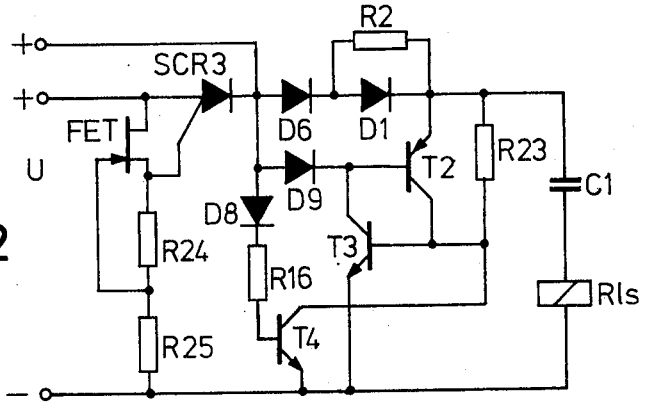

FIGS. 11 and 12 show alternatives of the circuit of FIG. 2. In FIG. 11, the diode D6 alone is connected in front of the diode D1, and another diode D9 is inserted in the input circuit of the semiconductor switch T2, T3, the cathode of the diode D9 being connected to the control electrode of the semiconductor switch. Yet another diode D8 is connected to the gase electrode of a transistor T4 in its forward direction with respect to the excitation voltage, the collector electrode of the transistor T4 being connected through an ohmic resistor R23 to the junction of the capacitor C1 and the semiconductor switch T2, T3. The measures prevent the semiconductor switch from being unintentionally switched over by higher excitation voltages U. Also, an overall reduction of the current load on the transistors T2, T3 is achieved.

Instead of the Zener diode ZD4 contained in the circuit of FIG. 2, the reference voltage for the trigger stage formed by the transistors T5, T6 is provided by a series connection of an ohmic resistor R7 and a Zener diode ZD2 connected in the blocking direction with respect to the polarity of the excitation voltage U, which series connection is inserted between the base electrode of the transistor T6 and the common ground potential of the circuit.

Two terminals marked by + are provided in both circuits of FIGS. 11 and 12, of which the upper terminal as shown in the drawing, which is directly connected to the input of the switch T2, T3 is provided for lower excitation voltages, while the lower terminal as shown in the drawing is provided for higher excitation voltages by virtue of having the further trigger stage T5, T6 connected to it.

The circuit arrangement of FIG. 12 differs from that of FIG. 11 by the fact that a controlled rectifier or thyristor SCR3 controlled by a field effect transistor FET replaces the further trigger stage T5, T6. The circuit of FIG. 12 has essentially the same function as that of FIG. 11.

What is claimed is:

1. A circuit arrangement for controlling a bistable relay in monostable fashion by the application and removal, respectively, of an excitation voltage, comprising (a) a series circuit connected across the excitation voltage and including the relay coil, a capacitor and first and second diodes poled in forward direction with respect to the excitation voltage, (b) ohmic resistors connected in parallel to each of said first and second diodes, and (c) trigger switching means connected in parallel to said series-connected relay coil and capacitor, said trigger switching means being rendered conductive by a reverse voltage occurring across said second diode when said excitation voltage is removed.

2. The circuit of claim 1, wherein said trigger switching means comprises a pair of pnp and npn type transistors, the collector of each one of which is connected to the base of the other, the base and emitter of one of said transistors being connected across said second diode.

3. The circuit of claim 1, wherein a second trigger switching means is connected in series between said first diode and one terminal of said excitation voltage, said second trigger switching means being turned on when said excitation voltage reaches a predetermined level.

4. The circuit of claim 3, wherein said second trigger switching means is constituted of a pair of pnp and npn type transistors, the collector of each one of said transistors is connected to the base of the other, said excitation voltage being detected by a circuit including a Zener diode, whereby said detected voltage allows said second trigger switching means to turn on.

5. A circuit arrangement for controlling a bistable relay in monostable fashion by the application and removal, respectively, of an excitation voltage, comprising (a) a series circuit connected across the excitation voltage and including the relay coil, a capacitor, a first diode and a Zener diode, both diodes poled in forward direction with respect to the excitation voltage, (b) an ohmic resistor connected in parallel to said first diode, (c) trigger switching means connected through the emitter-collector path of a series transistor in parallel to said series-connected relay coil and capacitor, the base of said series transistor being connected through a second diode to the side of said Zener diode connected to a terminal of said excitation voltage, said trigger switching means being rendered conductive by a reverse voltage occurring across said first diode when said excitation voltage is removed.

6. The circuit of claim 5, wherein said trigger switching means comprises a pair of pnp and npn type transistors, the collector of each one of which is connected to the base of the other; one of said transistors having its base and emitter connected across said first diode, the emitter of said one transistor being connected to one end of said series-connected relay coil and capacitor and the emitter of the other transistor being connected to the emitter of said series transistor; and the collector of said series transistor being connected to the other end of said series-connected relay coil and capacitor.

7. The circuit of claim 4, wherein said Zener diode is connected across the input and output terminals of said second trigger switching means in the reverse polarity with respect to said excitation voltage.

8. The circuit of claim 4, wherein said Zener diode is connected in series with a further diode and an ohmic resistor across said excitation voltage, said Zener diode being reversely poled and said further diode forwardly poled with respect to said excitation voltage.

9. A circuit arrangement for controlling a bistable relay in monostable fashion by the application and removal, respectively, of an excitation voltage, comprising (a) a series circuit connected across the excitation voltage and including the relay coil, a capacitor and first unidirectional switching means, (b) second switching means complementary to said first switching means and connected in parallel to said series-connected relay coil and capacitor, (c) a Schmitt trigger connected across said excitation voltage and having a reference voltage derived from said excitation voltage, the control electrodes of both said first and second switching means being connected to the collector of an output transistor of said Schmitt trigger, and (d) a feedback circuit connected across said first switching means for discharging said capacitor when said first switching means turns off.

10. The circuit of claim 9, wherein said feedback circuit includes a diode poled reversely with respect to said excitation voltage.

11. The circuit of claim 9, wherein said feedback circuit includes a transistor having its emitter and collector bridging said series-connected coil relay and capacitor and its base connected to the positive terminal of said excitation voltage through at least one reversely poled diode.

12. The circuit of claim 7, wherein the parallel circuit of said first diode and said ohmic resistor is replaced by a forwardly poled Zener diode.

13. A circuit arrangement for controlling a bistable relay in monostable fashion by the application and removal, respectively, of an excitation voltage, comprising (a) a series circuit connected across the excitation voltage and including the relay coil, a capacitor and first and second diodes poled in forward direction with respect to the excitation voltage, said second diode being bridged by an ohmic resistor, and (b) trigger switching means connected in parallel to said series-connected relay coil and capacitor, a control terminal of said trigger switching means being connected to the cathode of a third diode, which has its anode connected to the anode of said first diode, said trigger switching means being rendered conductive by a reverse voltage occurring across said second diode when said excitation voltage is removed.

14. The circuit of claim 13, wherein a series connection of a resistor and the emitter-collector path of a transistor is connected in parallel to said series-connected relay coil and capacitor, the junction of said series connection being connected to a second control electrode of said trigger switching means, the base of said transistor being connected through a forwardly poled fourth diode to the anodes of said first and third diodes.

15. The circuit of claim 14, wherein a second trigger switching means is connected in series between the anodes of said first, third and fourth diodes, said second trigger switching means being turned on when said excitation voltage reaches a predetermined level.

16. The circuit of claim 14, wherein a rectifier controllby a field effect transistor is connected in series between the anodes of said first, third and fourth diodes, said rectifier being turned on when said field effect transistor detects a predetermined level of said excitation voltage.

* * * * *